United States Patent [19]

Wirth, Jr.

[11] Patent Number: 4,705,261

[45] Date of Patent: Nov. 10, 1987

[54] WIRE INJECTION NOZZLE

[75] Inventor: Emil J. Wirth, Jr., Yardley, Pa.

[73] Assignee: Pfizer Inc., New York, N.Y.

[21] Appl. No.: 936,058

[22] Filed: Nov. 28, 1986

[51] Int. Cl.[4] ..... C21C 7/00

[52] U.S. Cl. ..... 266/287; 75/53; 75/58; 266/216

[58] Field of Search ..... 75/53, 58; 266/216, 266/287

[56] References Cited

U.S. PATENT DOCUMENTS

| | | | |
|---|---|---|---|
| 4,010,938 | 3/1977 | Crudup | 266/216 |
| 4,481,032 | 11/1984 | Kaiser | 75/58 |
| 4,512,800 | 4/1985 | Wirth, Jr. | 75/53 |

*Primary Examiner*—Peter D. Rosenberg

*Attorney, Agent, or Firm*—Peter C. Richardson; Lawrence C. Akers; Harold W. Ordway

[57] ABSTRACT

An injection nozzle for the addition of an agent in wire form directly into the interior of a molten material includes a tip having an axial bore with a terminal opening through which the wire exits the nozzle, the terminal opening having a cross section in the form of a star.

5 Claims, 5 Drawing Figures

WIRE INJECTION NOZZLE

BACKGROUND OF THE INVENTION

The present invention concerns an injection nozzle for use in the addition of an agent in wire form to such as molten steel.

In the steelmaking process, a ferrous melt produced in a suitable furnace is normally tapped into a ladle where it is treated with one or more agents to refine or alloy the melt. A refining agent commonly used to deoxidize, desulfurize and cause other desired solidification characteristics in the steel is calcium. Since calcium is lighter than the steel and is highly reactive, the calcium is preferably added in the form of an iron-clad wire introduced into the melt well below the melt surface through a refractory injection nozzle. A process highly suitable for such calcium addition is disclosed in U.S. Pat. No. 4,481,032.

An apparatus for introducing the calcium wire into the melt in such a process is disclosed in U.S. Pat. No. 4,512,800. With this apparatus, the wire passes through an injection nozzle having an orifice of novel configuration and circular cross section. An inert gas such as argon also passes through the orifice, in the annular space between the wire and orifice wall, and into the bath, the gas pressure in the nozzle being such as to prevent the melt from entering and plugging the orifice.

While the apparatus of U.S. Pat. No. 4,512,800 effectively injects the calcium wire into the melt, a more efficient means for introducing the protective gas into the melt is highly desirable. It is the primary objective of this invention to provide such a means.

SUMMARY OF THE INVENTION

It has now been found that both the calcium and the protective gas can be more efficiently utilized during such wire addition of calcium to molten steel by using an injection nozzle with a terminal opening having a cross section other than circular.

The present invention therefore entails an injection nozzle for the addition of an agent in wire form directly into the interior of a molten material, which comprises a tip having an axial bore with a terminal opening through which the wire exits the nozzle, the terminal opening having a cross section in the form of a star.

The star preferably has from six to twelve equally spaced points, especially eight points, and is of such size as to have a recess diameter of from about 101 to 110 percent of the wire diameter with a point diameter of from about 125 to 150 percent of the recess diameter. The tip of the nozzle is preferably replaceable.

The present invention also entails a method for the addition of an agent in wire form to a bath of molten metal, which comprises inserting the instant nozzle into the bath and feeding the agent downwardly through the nozzle while providing a sufficient flow of inert gas through the nozzle to maintain the nozzle essentially free of the metal. Preferably, the metal comprises iron and the agent comprises calcium.

BRIEF DESCRIPTION OF THE DRAWINGS

The features and advantages of the nozzle of the present invention will become clear from the following detailed description of a preferred embodiment thereof in conjunction with the accompanying drawings, in which.

DETAILED DESCRIPTION OF THE INVENTION

Figure 1:
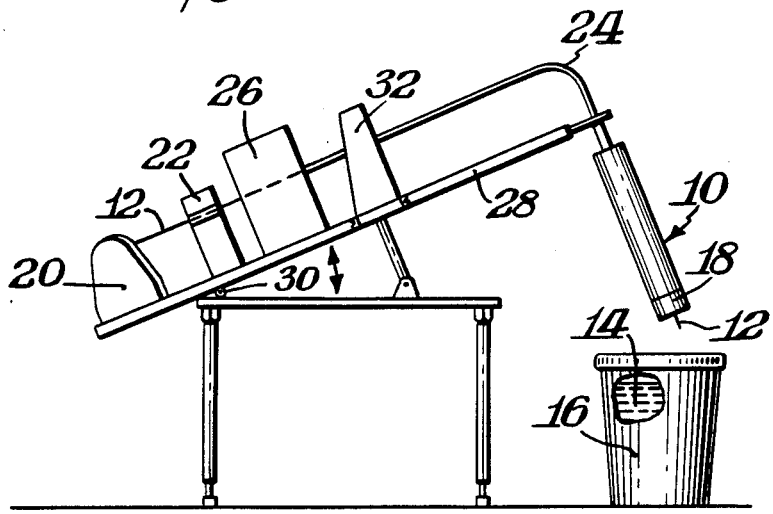
FIG. 1 is a side elevational view of the layout of parts of a wire injection apparatus employing the injection nozzle of the present invention.

A suitable apparatus arrangement for employing the injection nozzle of the present invention is shown in FIG. 1.

This apparatus includes injection nozzle 10 for injecting wire 12 into molten metal bath 14 contained in ladle 16 when replaceable tip 18 of nozzle 10 is immersed well below the surface of bath 14. Wire 12 is fed from reel 20 by feed mechanism 22 through gas-tight conduit 24 and nozzle 10 into bath 14. Inert gas is supplied to conduit 24, a seal mechanism 26 located immediately upstream of the gas input preventing loss of the gas around wire 12 in a direction backwards along the feed path. The arrangement is disposed on a pivotally-mounted table 28 which pivots on hinge 30. A hydraulic or pneumatic lifting device 32 lifts and lowers table 28, and thereby raises and lowers nozzle 10 with respect to bath 14. Such apparatus is described in detail in U.S. Pat. No. 4,512,800 which is incorporated herein in its entirety by reference.

Figure 2:
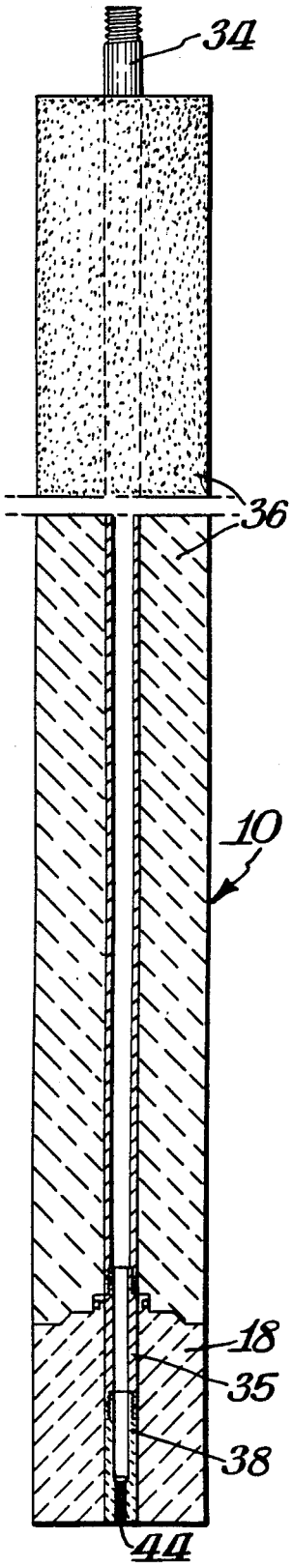
FIG. 2 is a side elevational view of the nozzle of FIG. 1 partially in cross section.

As shown in FIG. 2, nozzle 10, which includes tip 18, comprises core pipe 34 and its extension 35 encased within refractory casing 36. Core pipe 34, with an internal diameter of about 1 inch, may be of such as iron or steel while casing 36, with an outside diameter of about 8 inches, is constructed of such as alumina or other suitable refractory material. Nozzle 10 will normally be about 8 feet in length, with tip 18 being about 9 inches long. Tip 18 is replaceably attached to the remainder of nozzle 10 by a threaded connection or other suitable means between core pipe 34 and its extension 35. Core pipe extension 35 in tip 18 is threadably or otherwise mechanically connected to insert 38, which is about 6 inches long and preferably fabricated of a nonwetting material such as graphite. The connection of tip 18 to the remainder of nozzle 10 and the connection of insert 38 to core pipe extension 35 within tip 18 are both gas impermeable.

Figure 3:
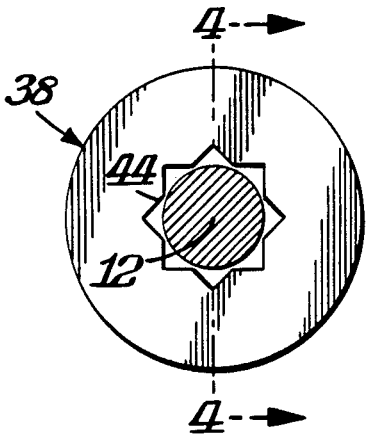
FIG. 3 is an end view of the insert portion of the nozzle of FIG. 1.
Figure 4:
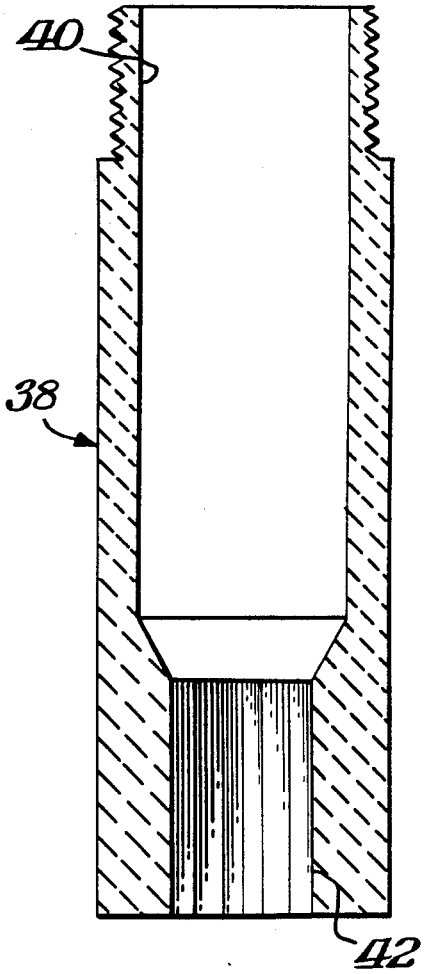
FIG. 4 is a cross-sectional view taken along the line 4—4 of FIG. 3.
Figure 5:
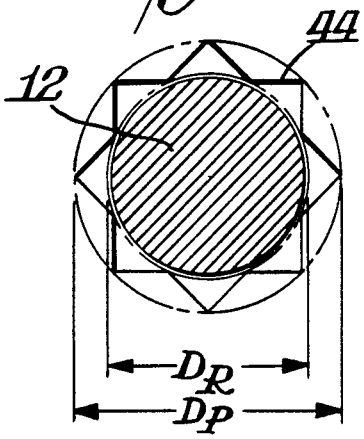
FIG. 5 is an enlarged view of FIG. 3 showing the relationship of the point and recess diameters.

Details of insert 38 are shown on FIGS. 3–5. Insert 38 has an axial bore 40 with a terminal opening 42 in the shape of a regular 8-point star 44. While star 44 is shown with eight equally spaced points, star 44 may suitably have five points or more, preferably six to 12 equally spaced points.

As shown in FIG. 5, star 44 will have a size depending on the size of the wire 12 being fed, the recess diameter $D_R$ of star 44 being just slightly larger than, preferably from about 101 to 110 percent of, the diameter of wire 12. This provides the desired inert gas flow pattern at terminal opening 42 and the symmetrical travel of wire 12 through terminal opening 42. Since most wires being fed to bath 14 will be from about 3 to 12 millimeters in diameter, recess diameter $D_R$ will therefore normally vary from about 3 to 13 millimeters. To further assure the desired inert gas flow pattern at terminal opening 42, point diameter $D_P$ of star 44 should be from about 110 to 200 percent, preferably from about 125 to 150 percent, of recess diameter $D_R$.

The present nozzle, with its terminal opening of unique cross section, offers a significant improvement over orifices such as that of U.S. Pat. No. 4,512,800 in which the cross-sectional area is circular. The star design creates a multitude of independent gas jets symmetrically surrounding the exiting wire, and thereby assits in centering the wire being fed within the opening. Its reduced free cross-sectional area significantly reduces the purging gas requirements. In addition, as shown on the following example, metallurgical results, including wire consumption efficiency, are improved.

EXAMPLE

A ferrous melt was tapped from a BOF furnace into a ladle, and the melt in the ladle was treated at 2950° F. (1620° C.) with calcium for nonmetallic inclusion modification. The calcium was in the form of a 0.307 inch (7.8 millimeter) steel-clad wire, and was added to the melt by the technique of U.S. Pat. No. 4,481,032.

Initially, an injection nozzle with a circular exit orifice of 0.410 inch (10.4 millimeter) diameter was employed. Some 80 pounds of calcium (0.45 lb/ton melt) was added to the melt over a 4–5 minute period to produce the desired final calcium level of 50 ppm in the melt. An argon protective gas flow of 25 SCFM was required to prevent blockage of the exit orifice by the melt, a total of 125 SCF of argon being consumed. Calcium recovery was 22.5 percent.

The calcium addition was then repeated with a similar melt using a similar nozzle but with an exit orifice in the form of a regular 8-point star, the star having a recess diameter ($D_R$) of 0.310 inch (7.9 millimeters) and a point diameter ($D_p$) of 0.410 inch (10.4 millimeters). The addition required only 54 pounds of calcium (0.30 lb/ton melt) to obtain the same final calcium level as in the initial treatment, and an argon protective gas flow of only 9.5 SCFM to maintain the orifice free of melt. A total of 43 SCF of argon was consumed, and the calcium recovery was 30.5 percent.

I claim:

1. An injection nozzle for the addition of an agent in wire form directly into the interior of a molten material, which comprises a tip having an axial bore with a terminal opening through which the wire exits the nozzle, the terminal opening having a cross section in the form of a star configured to produce a multitude of independent gas jets symmetrically surrounding the exiting wire.

2. The nozzle of claim 1 wherein the star has from six to twelve equally spaced points.

3. The nozzle of claim 2 wherein the star has eight points.

4. The nozzle of claim 2 wherein the star has a recess diameter of from about 101 to 110 percent of the wire diameter and a point diameter of from aboout 125 to 150 percent of the recess diameter.

5. The nozzle of claim 1 wherein the tip of the nozzle is replaceable.

* * * * *